US009655225B2

(12) United States Patent
Bezel et al.

(10) Patent No.: US 9,655,225 B2
(45) **Date of Patent: *May 16, 2017**

(54) METHOD AND SYSTEM FOR CONTROLLING CONVECTION WITHIN A PLASMA CELL

(71) Applicant: KLA-Tencor Corporation, Milpitas, CA (US)

(72) Inventors: Ilya Bezel, Sunnyvale, CA (US); Anatoly Shchemelinin, Pleasanton, CA (US); Matthew Derstine, Los Gatos, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/935,774

(22) Filed: Nov. 9, 2015

(65) Prior Publication Data

US 2016/0066402 A1 Mar. 3, 2016

Related U.S. Application Data

(63) Continuation of application No. 14/288,092, filed on May 27, 2014, now Pat. No. 9,185,788.

(Continued)

(51) Int. Cl.
*H05H 1/24* (2006.01)
*H01J 61/30* (2006.01)

(Continued)

(52) U.S. Cl.
CPC ..... *H05H 1/24* (2013.01); *H01J 61/30* (2013.01); *H01J 65/04* (2013.01); *H05G 2/003* (2013.01); *H05G 2/008* (2013.01)

(58) Field of Classification Search
CPC combination set(s) only.
See application file for complete search history.

(56) References Cited

U.S. PATENT DOCUMENTS 7,435,982 B2 10/2008 Smith
7,786,455 B2 8/2010 Smith (Continued)

FOREIGN PATENT DOCUMENTS

WO 2013055906 A1 4/2013

OTHER PUBLICATIONS

A. Schreiber et al., Radiation Resistance of Quartz Glass for VUV Discharge Lamps, Journal of Physics D: Applied Physics, vol. 38, pp. 3242-3250, Published Aug. 19, 2005, IOP Publishing Ltd, Printed in the UK.

(Continued)

*Primary Examiner* — Phillip A Johnston
*Assistant Examiner* — Hsien Tsai
(74) *Attorney, Agent, or Firm* — Suiter Swantz pc llo

(57) ABSTRACT

A plasma cell for controlling convection includes a transmission element configured to receive illumination from an illumination source in order to generate a plasma within a plasma generation region of the volume of gas. The transmission element of the plasma cell is at least partially transparent to at least a portion of the illumination generated by the illumination source and at least a portion of broadband radiation emitted by the plasma. The plasma cell also includes one or more gas return channels formed within the transmission element for transferring gas from a region above the plasma generation region to a region below the plasma generation region.

43 Claims, 7 Drawing Sheets

Related U.S. Application Data

(60) Provisional application No. 61/828,574, filed on May 29, 2013.

(51) Int. Cl.
*H01J 65/04* (2006.01)
*H05G 2/00* (2006.01)

(56) References Cited

U.S. PATENT DOCUMENTS

| | | | | |
|---|---|---|---|---|
| 9,185,788 | B2 * | 11/2015 | Bezel | H01J 65/04 |
| 2004/0135517 | A1 * | 7/2004 | Schriever | H05G 2/003 315/111.21 |
| 2007/0228288 | A1 | 10/2007 | Smith | |
| 2007/0228300 | A1 | 10/2007 | Smith | |
| 2010/0264820 | A1 | 10/2010 | Sumitomo et al. | |
| 2011/0204265 | A1 | 8/2011 | Smith et al. | |
| 2013/0003384 | A1 | 1/2013 | Bezel et al. | |
| 2013/0106275 | A1 | 5/2013 | Chimmalgi | |
| 2013/0342105 | A1 * | 12/2013 | Shchemelinin | H01J 37/32055 315/111.21 |
| 2014/0291546 | A1 * | 10/2014 | Bezel | H01J 65/00 250/432 R |

OTHER PUBLICATIONS

00012787827, May 26, 2010, Ilya Bezel.
00014231196, Mar. 31, 2014, Ilya Bezel.

* cited by examiner

METHOD AND SYSTEM FOR CONTROLLING CONVECTION WITHIN A PLASMA CELL

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a continuation patent application of United States Non-Provisional Patent Application entitled METHOD AND SYSTEM FOR CONTROLLING CONVECTION WITHIN A PLASMA CELL, naming Ilya Bezel, Anatoly Shchemelinin and Matthew Derstine as inventors, filed May 27, 2014, application Ser. No. 14/288,092, which constitutes a regular (non-provisional) patent application of United States Provisional Patent Application entitled PLASMA CELL FLOW CONTROL, naming Ilya Bezel, Anatoly Shchemelinin and Matthew Derstine as inventors, filed May 29, 2013, application Ser. No. 61/828,574. Both of the applications listed above are incorporated herein by reference in the entirety.

TECHNICAL FIELD

The present invention generally relates to plasma-based light sources, and, more particularly, to a plasma cell with gas flow control capabilities.

BACKGROUND

As the demand for integrated circuits having ever-smaller device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. Traditional plasma cells include plasma bulbs for containing the gas used to generate plasma. Commonly implemented plasma bulbs display unstable gas flow. The unstable flow typically leads to noise in the plasma as a result of 'air wiggle.' Further, the plasma disruptions caused by air wiggle tend to grow with larger and larger bulb form factor. Therefore, it would be desirable to provide a system and method for curing defects such as those of the identified above.

SUMMARY

A plasma cell for controlling convection is disclosed, in accordance with an illustrative embodiment of the present disclosure. In one embodiment, the plasma cell includes a transmission element having one or more openings. In another embodiment, the transmission element is configured to receive illumination from an illumination source in order to generate a plasma within a plasma generation region of the volume of gas. In another embodiment, the plasma emits broadband radiation, wherein the transmission element of the plasma cell is at least partially transparent to at least a portion of the illumination generated by the illumination source and at least a portion of the broadband radiation emitted by the plasma. In another embodiment, the plasma cell includes one or more gas return channels formed within the transmission element for transferring gas from a region above the plasma generation region to a region below the plasma generation region.

A plasma cell for controlling convection is disclosed, in accordance with another illustrative embodiment of the present disclosure. In one embodiment, the plasma cell includes a plasma bulb configured to receive illumination from an illumination source in order to generate a plasma within a plasma generation region of a volume of gas within the plasma bulb. In another embodiment, the plasma emits broadband radiation, wherein the plasma bulb is at least partially transparent to at least a portion of the illumination generated by the illumination source and at least a portion of the broadband radiation emitted by the plasma. In another embodiment, the plasma cell includes one or more gas return channels formed within the plasma bulb for transferring gas from a region above the plasma generation region to a region below the plasma generation region.

A system for controlling convection in a plasma cell is disclosed, in accordance with an additional illustrative embodiment of the present disclosure. In one embodiment, the system includes an illumination source configured to generate illumination. In another embodiment, the system includes a plasma cell including a transmission element having one or more openings. In another embodiment, the transmission element is configured to receive illumination from the illumination source in order to generate a plasma within a plasma generation region of the volume of gas. In another embodiment, the plasma emits broadband radiation, wherein the transmission element of the plasma cell is at least partially transparent to at least a portion of the illumination generated by the illumination source and at least a portion of the broadband radiation emitted by the plasma. In another embodiment, the plasma cell includes one or more gas return channels formed within the transmission element for transferring gas from a region above the plasma generation region to a region below the plasma generation region. In another embodiment, the system includes a collector element arranged to focus the illumination from the illumination source into the volume of gas in order to generate a plasma within the volume of gas contained within the plasma cell.

A method for controlling convection in a plasma cell is disclosed, in accordance with an additional illustrative embodiment of the present invention. In one embodiment, the method may include generating illumination. In another embodiment, the method includes containing a volume of gas within a plasma cell. In another embodiment, the method includes focusing at least a portion of the generated illumination through a transmission element of the plasma cell into the volume of gas contained within the plasma cell. In another embodiment, the method includes generating broadband radiation by forming a plasma via absorption of the focused generated illumination by at least a portion of the volume of gas contained within the plasma cell. In another embodiment, the method includes transmitting at least a portion of the broadband radiation through the transmission element of the plasma cell. In another embodiment, the method includes transferring gas from a region above the plasma generation region to a region below the plasma generation region with one or more gas return channels.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Figure 1A:
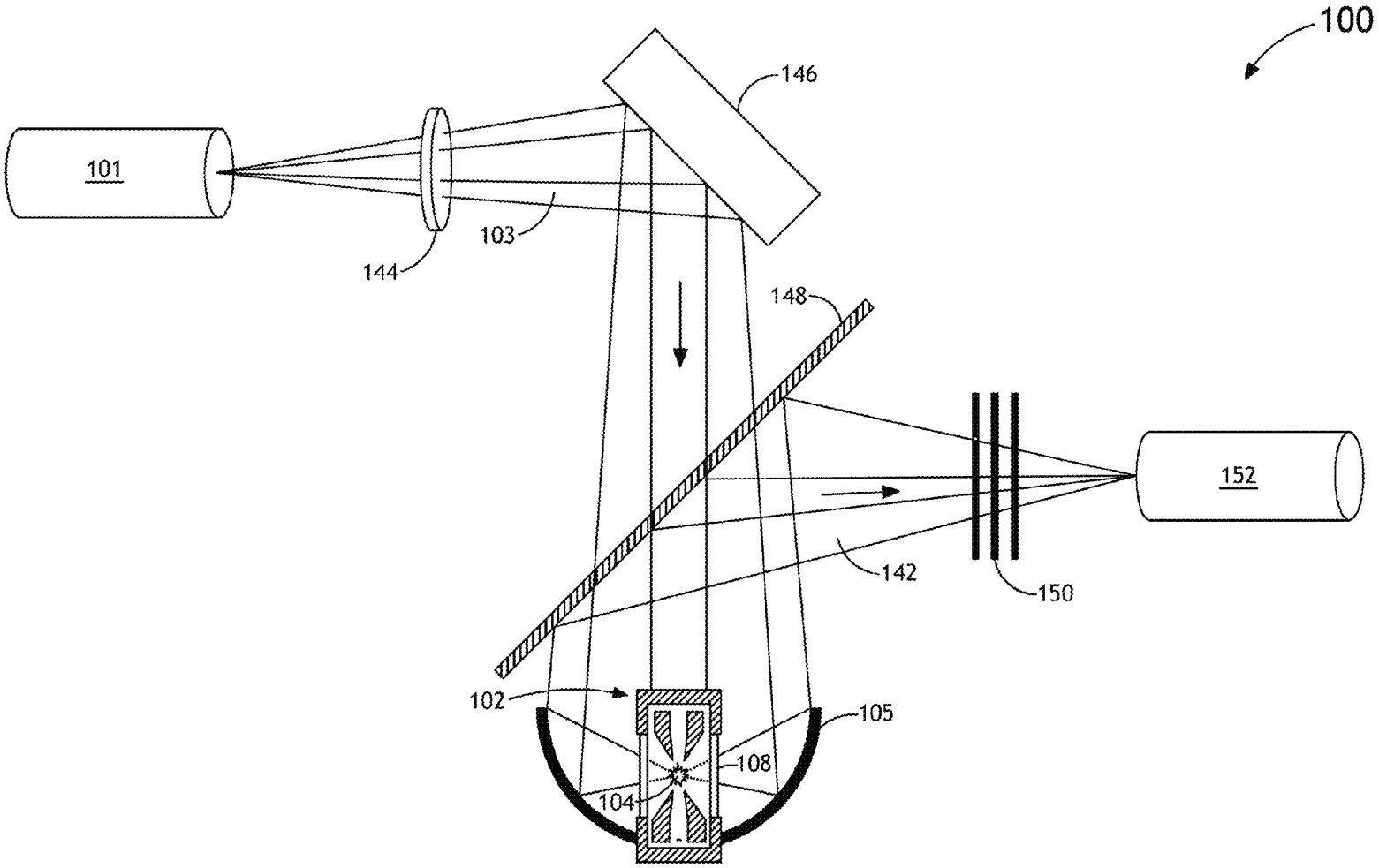
FIG. 1A is a high level schematic view of a system for forming a light-sustained plasma, in accordance with one embodiment of the present invention.
Figure 1B:
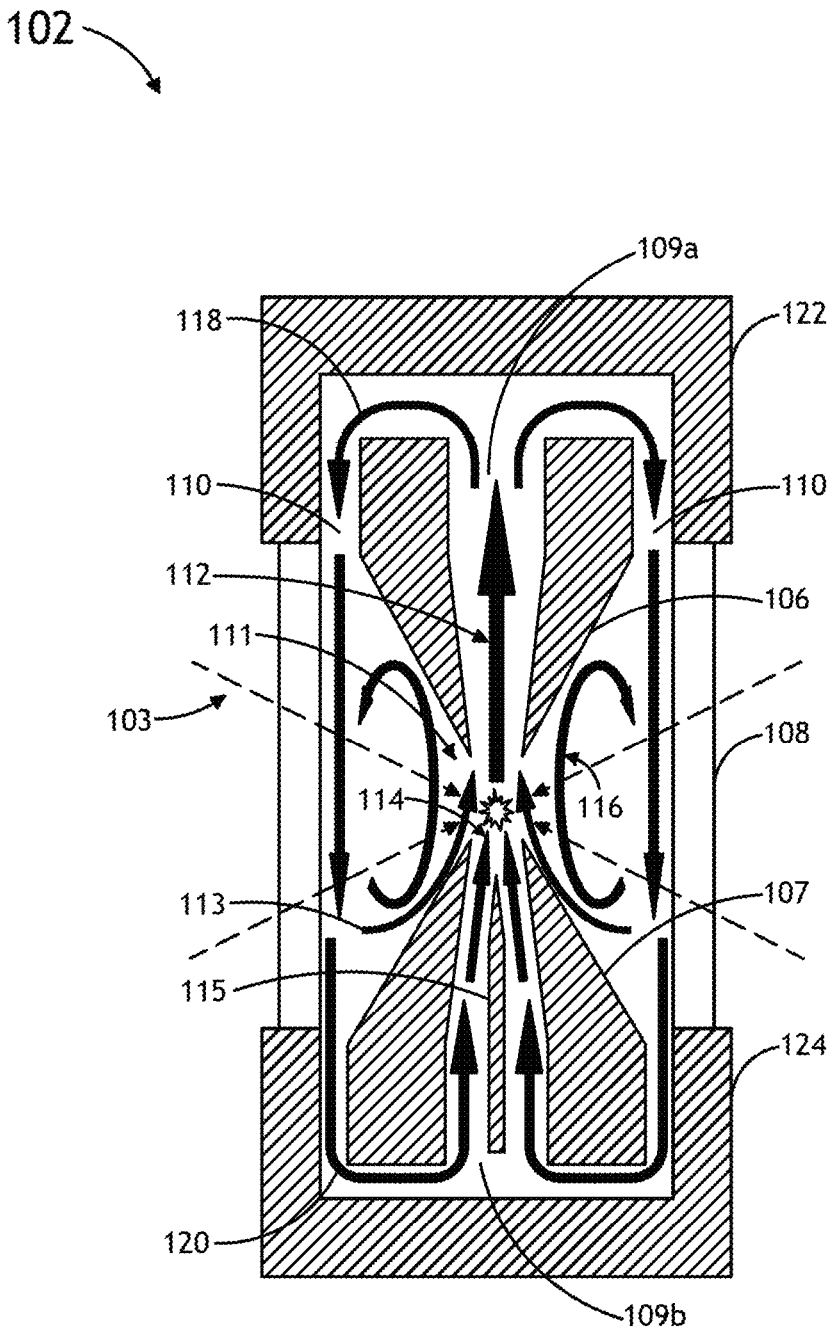
FIG. 1B is a high level schematic view of a plasma cell equipped with one or more flow control elements, in accordance with one embodiment of the present invention.
Figure 1C:
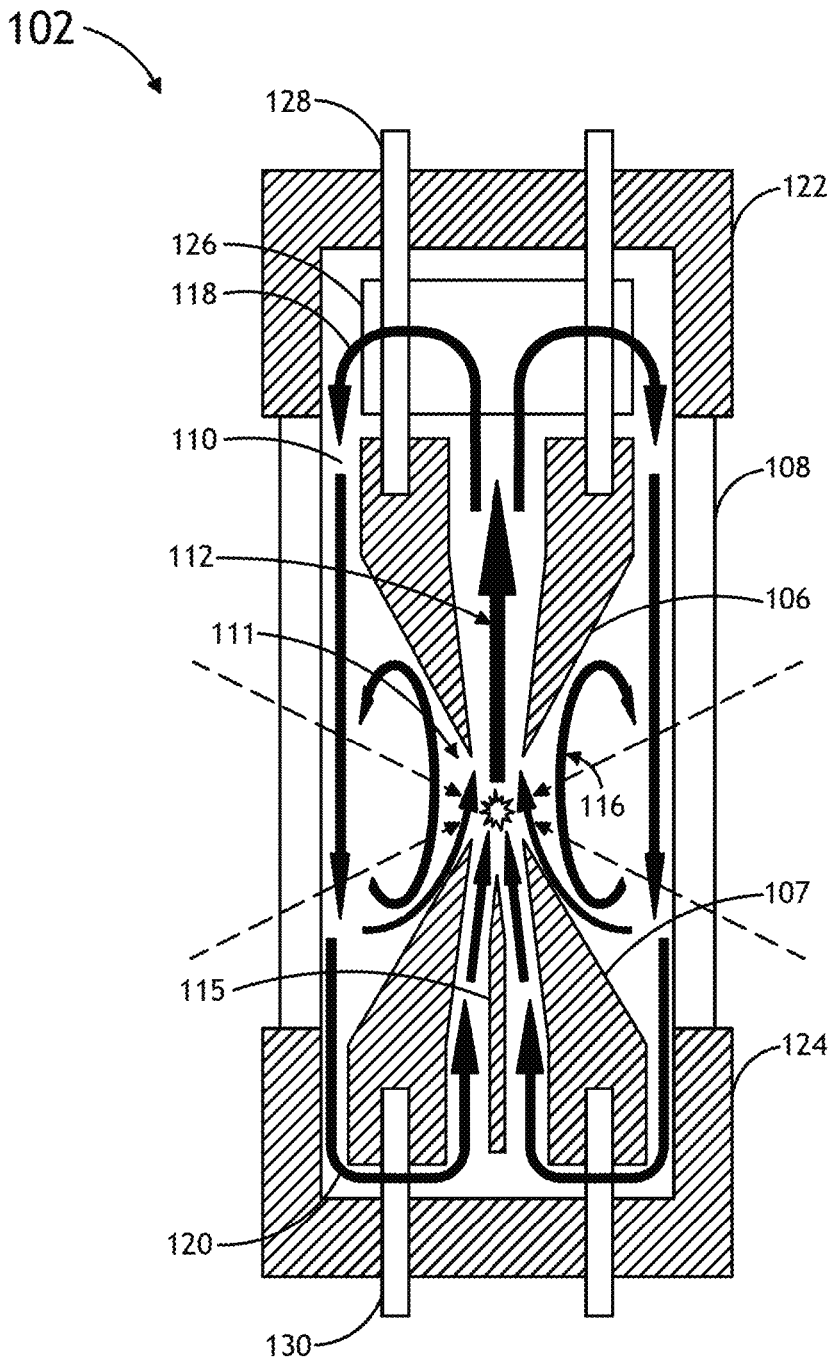
FIG. 1C is a high level schematic view of a plasma cell equipped with one or more flow control elements, in accordance with one embodiment of the present invention.
Figure 1D:
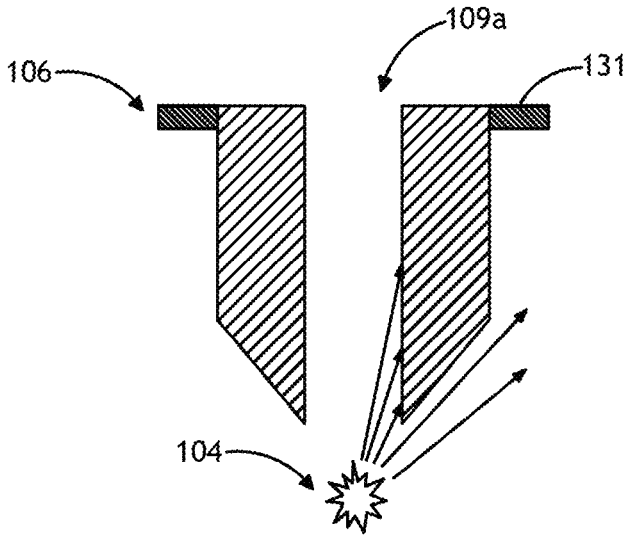
FIG. 1D is a high level schematic view of a top flow control element arranged to serve as a radiation shield, in accordance with one embodiment of the present invention.
Figure 1E:
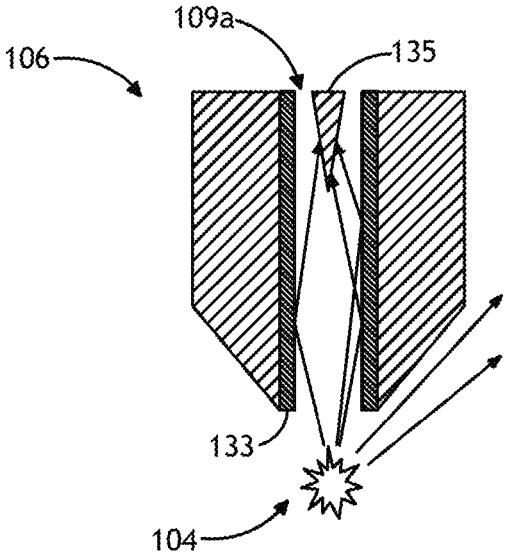
FIG. 1E is a high level schematic view of a top flow control element including an internal channel coated with a reflective material, in accordance with one embodiment of the present invention.
Figure 1F:
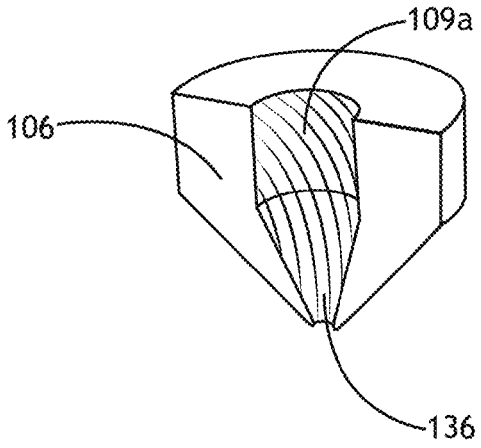
FIG. 1F is a high level schematic view of a top flow control element including rifling features on the external surface of the top flow control element, in accordance with one embodiment of the present invention.
Figure 1G:
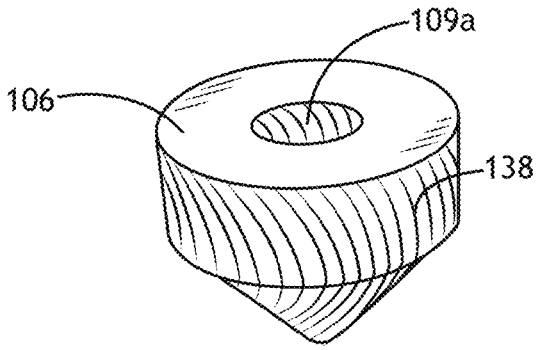
FIG. 1G is a high level schematic view of a top flow control element including rifling features on the surface of the internal channel of top flow control element, in accordance with one embodiment of the present invention.
Figure 1H:
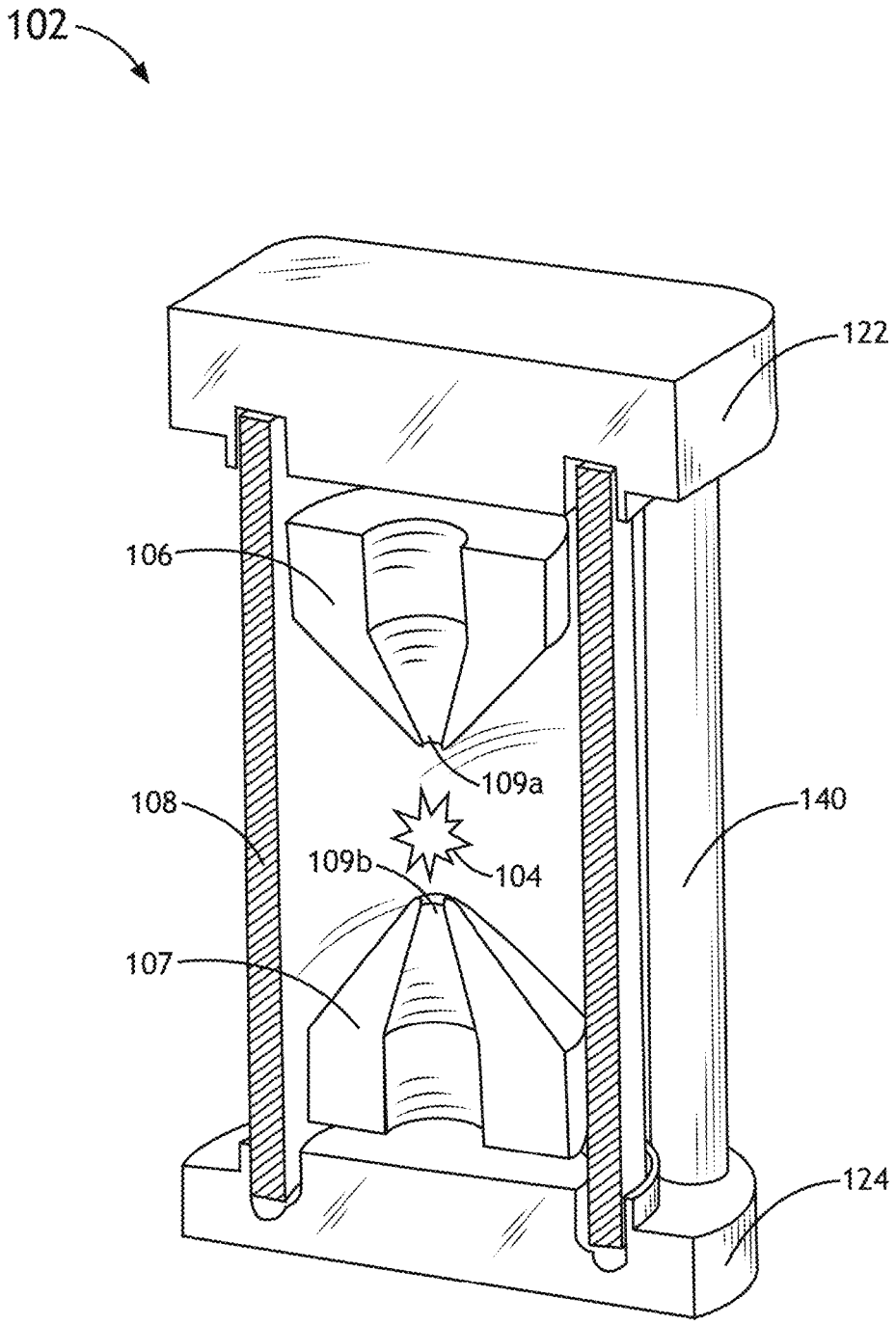
FIG. 1H is a cross-sectional view of a plasma cell equipped with one or more flow control elements, in accordance with one embodiment of the present invention.
Figure 2:
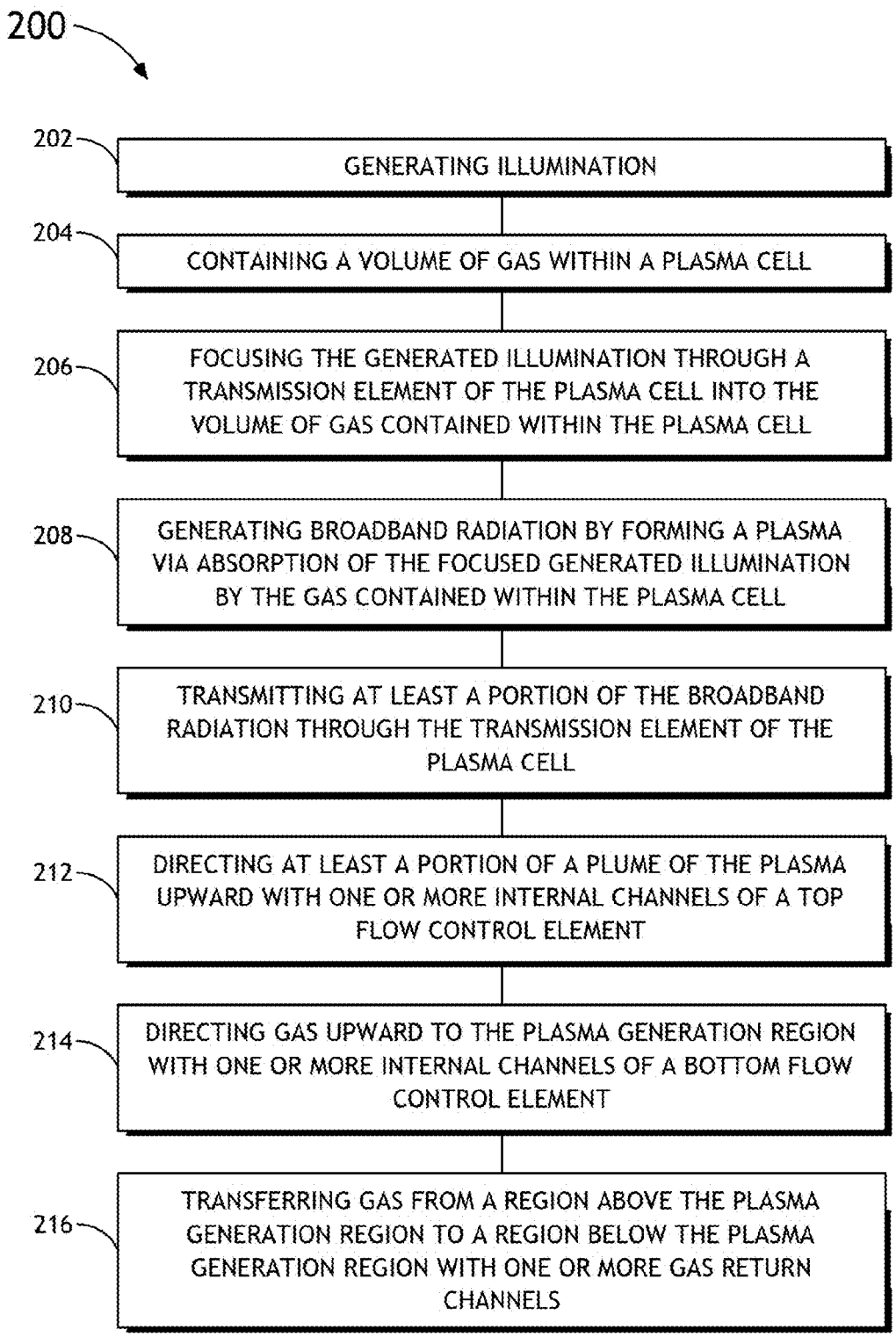
FIG. 2 is a flow diagram illustrating a method for controlling convection in a plasma cell, in accordance with one embodiment of the present invention.

Referring generally to FIGS. 1A through 2, a system and method for controlling convection within a plasma cell are described in accordance with the present disclosure. Embodiments of the present disclosure are directed to the generation of radiation with a light-sustained plasma light source. Embodiments of the present invention provide a plasma cell equipped with a transmission element (or bulb) that is transparent to both the pumping light (e.g., light from a laser source) used to sustain a plasma within the plasma cell and broadband radiation emitted by the plasma. Further embodiments of the present disclosure provide for gas and/or plasma flow throughout the plasma cell using a top flow control element and a bottom flow control element. These control elements may serve to control gas flow into the plasma generation region of the plasma cell as well as aid in controlling returning cool gas from a region above the plasma generation region to a region below the plasma generation region. Embodiments of the present invention may control (e.g., control speed) gas flow in a gas return loop, allowing the plasma cell to maintain a steady flow pattern throughout the region of light propagation (e.g., laser propagation) used to pump the plasma. Embodiments of the present disclosure may also provide for active control of gas flow rates throughout the plasma cell via active cooling/heating elements of the plasma cell and convection enhancement elements, such as thermal or mechanical pumps.

FIGS. 1A-1H illustrate a system 100 for forming a light-sustained plasma suitable for emitting broadband illumination, in accordance with an embodiment of the present invention. The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety. Various plasma cell designs and plasma control mechanisms are described in U.S. patent application Ser. No. 13/647,680, filed on Oct. 9, 2012, which is incorporated herein by reference in the entirety. The generation of plasma is also generally described in U.S. patent application Ser. No. 14/224,945, filed on Mar. 25, 2014, which is incorporated by reference herein in the entirety.

In one embodiment, the system 100 includes an illumination source 101 (e.g., one or more lasers) configured to generate illumination of a selected wavelength, or wavelength range, such as, but not limited to, infrared radiation. In another embodiment, the system 100 includes a plasma cell 102 for generating, or maintaining, a plasma 104. In another embodiment, the plasma cell 102 includes a transmission element 108. In one embodiment, the transmission element 108 is configured to receive illumination from the illumination source 101 in order to generate a plasma 104 within a plasma generation region 111 of a volume of gas contained within the plasma cell 102. In this regard, the transmission element 108 is at least partially transparent to the illumination generated by the illumination source 101, allowing illumination delivered by the illumination source 101 (e.g., delivered via fiber optic coupling or delivered via free space coupling) to be transmitted through the transmission element 108 into the plasma cell 102. In another embodiment, upon absorbing illumination from source 101, the plasma 104 emits broadband radiation (e.g., broadband IR, broadband visible, broadband UV, broadband DUV and/or broadband EUV radiation). In another embodiment, the transmission element 108 of the plasma cell 102 is at least partially transparent to at least a portion of the broadband radiation emitted by the plasma 104.

In another embodiment, the plasma cell 102 includes one or more flow control elements. In one embodiment, the one or more flow control elements of the plasma cell 102 include a top flow control element 106. In one embodiment, top flow control element 106 includes a top deflector. For example, the top flow control element 106 may include a plume and/or gas flow deflector suitable for deflecting plume/gas flow along a desired pathway. In another embodiment, the one or more flow control elements of the plasma cell 102 include a bottom flow control element 107. In another embodiment, the bottom flow control element 107 includes a bottom deflector. For example, the bottom flow control element 107 may include a gas flow director suitable for deflecting gas flow along a desired pathway.

In another embodiment, the top flow control element 106 includes one or more internal channels 109*a*. For example, the one or more internal channels 109*a* of the top flow control element 106 may serve to direct the plume of plasma 104 upward. By way of another example, the one or more internal channels 109*a* of the top flow control element 106 may serve to direct hot gas 112 from the plasma upward, as shown in FIGS. 1B and 1C. In another embodiment, the bottom flow control element 107 includes one or more internal channels 109*b*. For example, the one or more internal channels 109*b* of the bottom flow control element 107 may serve to direct the gas of plasma 104 upward and/or gas upward, as shown in FIGS. 1B and 1C.

In one embodiment, the top flow control element 106 and the bottom flow control element 107 are arranged within the transmission element 108 to form one or more gas return channels 110 for transferring gas from a region above the plasma generation region 111 to a region below the plasma generation region 111. For example, the bottom internal channel 109*b* may direct gas upward into the plasma generation zone 111. Then, the top internal channel 109*a* may direct the plume of plasma 104 and/or hot gas from the plasma 104 upward to a region above the top flow control element 106. Then, the gas carried to the region above the top flow control element 106 may undergo cooling (e.g., natural cooling or cooling via heat exchange element 126 (e.g., heat exchanger). In addition, the gas may be further directed to the bottom portion of the plasma cell 102 via the one or more gas return channels 110 defined by the outer surfaces of the flow control elements 106, 107 and the internal wall of the plasma cell 102 (e.g., transmission element 108, flanges 122, 124 and the like). As discussed in greater detail further herein, the gas flow loop described herein and depicted in FIGS. 1B and 1C may be enhanced via one or more gas pumps (e.g., thermal pump or mechanical pump).

In one embodiment, the top flow control element 106 is configured to form one or more top circulation loops 118. For example, the top flow control element 106 may be arranged within the transmission element 108 (and terminating top portion (e.g., top flange 122)) so as to form a top circulation loop 118, as shown in FIGS. 1B and 1C.

In one embodiment, the bottom flow control element 106 is configured to form one or more bottom circulation loops 120. For example, the bottom flow control element 107 may be arranged within the transmission element 108 (and terminating bottom portion (e.g., bottom flange 124)) so as to form a bottom circulation loop 120, as shown in FIGS. 1B and 1C.

In another embodiment, the top flow control element 106 and the bottom flow control element 107 are arranged within the transmission element 108 to form one or more gas return channels 110 for transferring gas from the one or more top circulation loops 118 to the one or more bottom circulation loops 120. In this regard, the one or more as return channels 110 formed, at least in part, by the top flow control element 106, the bottom flow control element and the internal wall of the transmission element 108 may serve to fluidically couple the one or more top circulation loops 118 with the one or more bottom circulation loops 120.

In this regard, the top flow control element 106 and the bottom flow control element 107 may be configured to balance a flow of gas 112 from the plume of the plasma 104 with the flow of gas 114 delivered to the plasma 104. For example, the top flow control element 106 and the bottom flow control element 107 may be shaped and/or positioned relative to the internal wall of the transmission element 108 in a manner suitable to balance a flow of gas 112 from the plume of the plasma 104 with the flow of gas 114 delivered to the plasma 104. In another embodiment, the top flow control element 106 and the bottom flow control element 107 may be configured to balance a flow of gas 112 from the plume of the plasma 104 with the flow of gas 114 delivered to the plasma 104 in order to maintain a gas flow rate of one or more center circulation loops 116 at or below a selected level. It is noted herein that the gas flow 114 through the bottom flow control element 107 toward the plasma 104 and the gas flow 112 through the top control element 106 may induce a suction flow 113, which may impact the stability of flow within the center circulation loops 116. It is recognized that a reduction in the speed of the gas flow in the gas return loop 110 may aid in maintaining a steady flow pattern throughout the entire region of light propagation (e.g., laser propagation) from the illumination source 101. Further, balancing the amount of gas delivered to the plasma 104 with the gas flow from the plume of the plasma 104 may lead to a minimization (or at least reduction) of the rate of gas flow of one or more center circulation loops 116. It is further noted herein that such a minimization, or at least reduction, in the in the flow rate of the center circulation loops 116 may result in increased stability in the flow (e.g., laminar flow).

It is recognized herein that the top flow control element 106 and/or the bottom flow control element 107 may take on any shape suitable to establish a desired gas flow return channel as described throughout the present disclosure. In one embodiment, the top flow control element 106 and/or the bottom flow control element 107 are substantially made up of one or more geometric shapes. In another embodiment, the top flow control element 106 and/or the bottom flow control element 107 are symmetric. In one embodiment, the top flow control element 106 and/or the bottom flow control element 107 are cylindrically symmetric. In one embodiment, the top flow control element 106 and/or the bottom flow control element 107 may include one or more conical portions (e.g., cone, truncated cone and the like). In another embodiment, the top flow control element 106 and/or the bottom flow control element 107 may include one or more cylindrical portions (e.g., cylinder). In another embodiment, the top flow control element 106 and/or the bottom flow control element 107 may have a composite structure. For example, as shown in FIGS. 1B-1C, the composite structure of the top flow control element 106 and/or the bottom flow control element 107 may include a conical portion and a cylindrical portion. It is further noted herein that the above description and the embodiments depicted in FIGS. 1A-1C are not limiting, but provided merely for illustrative purposes. The top flow control element 106 and/or the bottom flow control element 107 may include any geometric shape, a portion of a geometric shape or combination of geometric shapes known in the art, such as, but not limited to, a cone, a truncated cone, a cylinder, a prism (e.g., triangular prism, trapezoidal prism, parallelepiped prism, hexagonal prism, octagonal prism and the like), a tapered prism, an ellipsoid, a frustum and the like.

In one embodiment, the top flow control element 106 and/or the bottom flow control element 107 are not cylindrically symmetric. It is noted herein that the use of structures in the plasma cell 102 that are not cylindrically symmetric may aid in stabilizing gas flow in the horizontal plane. For example, the top flow control element 106 and/or the bottom flow control element 107 may include structures having a rectangular cross-section. In another embodiment, the top flow control element 106 and/or the bottom flow control element 107 are asymmetric.

It is further recognized herein that the one or more internal channels 109*a*, 109*b* of the top flow control element 106 and/or the bottom flow control element 107 may take on any shape suitable to establish a desired gas flow loop, as shown in FIGS. 1B and 1C. It is recognized herein that the one or more internal channels 109*a*, 109*b* of the top flow control element 106 and/or the bottom flow control element 107 may be formed by way of any technique known in the art. For example, the internal channels 109*a*, 109*b* may be formed during a casting or molding process of the one or more control elements 106, 107. By way of another example, the internal channels 109*a*, 109*b* may be formed during a machining process of the one or more control elements 106, 107.

In one embodiment, the one or more internal channels 109*a*, 109*b* formed in the top flow control element 106 and/or the bottom flow control element 107 may have any geometric shape known in the art. In one embodiment, the one or more internal channels 109*a*, 109*b* of the top flow control element 106 and/or the bottom flow control element 107 are asymmetric. In another embodiment, the one or more internal channels 109*a*, 109*b* of the top flow control element 106 and/or the bottom flow control element 107 are symmetric.

In one embodiment, the one or more internal channels 109*a*, 109*b* of the top flow control element 106 and/or the bottom flow control element 107 are cylindrically symmetric. In one embodiment, the one or more internal channels 109*a*, 109*b* of the top flow control element 106 and/or the bottom flow control element 107 may include one or more conical portions (e.g., cone, truncated cone and the like). In another embodiment, the one or more internal channels 109*a*, 109*b* of the top flow control element 106 and/or the bottom flow control element 107 may include one or more cylindrical portions (e.g., cylinder). In another embodiment, the one or more internal channels 109*a*, 109*b* of the top flow control element 106 and/or the bottom flow control element 107 may have a composite structure. For example, as shown in FIGS. 1B-1C, the composite structure of the one or more internal channels 109*a*, 109*b* of the top flow control element 106 and/or the bottom flow control element 107 may include a conical portion and a cylindrical portion. It is further noted herein that the above description and the embodiments depicted in FIGS. 1A-1C are not limiting, but provided merely for illustrative purposes. The one or more internal channels 109*a*, 109*b* of the top flow control element 106 and/or the bottom flow control element 107 may include any geometric shape, a portion of a geometric shape or combination of geometric shapes known in the art, such as, but not limited to, a cone, a truncated cone, a cylinder, a prism (e.g., triangular prism, trapezoidal prism, parallelepiped prism, hexagonal prism, octagonal prism and the like), a tapered prism, an ellipsoid, a frustum and the like.

In another embodiment, one or more convection enhancement elements 115 are disposed within one or more internal channels 109*a*, 109*b* of the top flow control element 106 of the bottom flow control element 107. For example, as shown in FIGS. 1B and 1C, a convention enhancement element 115 may be disposed within the internal channel 109*b* of the bottom flow control element 107. By way of another example, although not shown, a convention enhancement element 115 may be disposed within the internal channel 109*a* of the top flow control element 106.

In one embodiment, the one or more convection enhancement elements 115 disposed within the one or more internal channels 109*a*, 109*b* may include, but are not limited to, one or more gas pumps. It is noted herein that the use of one or more gas pumps within the one or more internal channels 109*a*, 109*b* may enhance convective flow directed at the plasma 104. For example, the internal channel 109*b* of the bottom flow control element 107 may include a convection enhancement element 115 for providing gas flow to the plasma 104. In another embodiment, the one or more convention enhancement elements 115 disposed within the one or more internal channels 109*a*, 109*b* may include, but are not limited to, one or more thermal gas pumps. It is noted herein that a thermal pump may take on any shape known in the art. For example, the one or more convention enhancement elements 115 disposed within the one or more internal channels 109*a*, 109*b* may include, but are not limited to, a heated rod (e.g., cylinder, tapered rod and the like) or heated pipe (as shown in FIGS. 1B and 1C). It is further noted that a thermal pump of the present invention may be formed from any material known in the art. For example, the one or more convention enhancement elements may be formed from, but need not be formed from, tungsten, aluminum, copper and the like. Further, it is recognized herein that a heated rod or heated pipe used as a thermal pump may be heated via the absorption of radiation from the plasma 104 (see FIG. 1E).

In another, the bottom flow control element 107 itself may be heated in order to drive gas flow into the plasma 104. For example, the bottom flow control element 107 may be heated via radiation from the plasma 104 or may be heated by an external heat source (e.g., via a heat exchanger (not shown)).

In other embodiments, the one or more convection enhancement elements 115 may include, but are not limited to, a hollow jet, a mechanical pump, or an external recirculation pump. For example, the internal channel 109*b* of the bottom flow control element 107 may include at least one of a hollow jet, a mechanical pump, a mechanical blower (e.g., magnetically coupled fan), an external recirculation pump, for providing gas flow to the plasma 104.

It is noted herein that the top flow control element 106, the bottom flow control element 107 and the one or more convection enhancement elements 115 of the plasma cell 102 may be mechanically stabilized in any manner known in the art. For example, although not shown for reasons of clarity, the plasma cell 102 may include one or more stabilizing structures used for mechanically securing the top flow control element 106, the bottom flow control element 107 and the one or more convention enhancement elements 115 of the plasma cell 102. In some embodiments, the one or more convection enhancements elements 115 may be mechanically coupled to the internal wall of the flow control elements 106, 107. In other embodiments, the one or more convection enhancements elements 115 may be mechanically coupled to the flanges 122, 124.

In another embodiment, as shown in FIG. 1C, the plasma cell 102 may include one or more thermal control elements. For example, the one or more temperature control elements may be disposed inside or outside of the plasma cell 102. The temperature control element may include any temperature control element known in the art used to control the temperature of the plasma cell 102, the plasma 104, the gas, the transmission element 108 (or bulb), the one or more flanges 122,124, the top flow control element 106, the bottom flow control element 107, the one or more convection enhancement elements 115 and/or the plasma plume (not shown).

In one embodiment, the one or more temperature control elements may be utilized to cool the plasma cell 102, the plasma 104, the gas, the transmission element 108 (or bulb), the one or more flanges 122,124, the top flow control element 106, the bottom flow control element 107, the one or more convection enhancement elements 115 and/or the plasma plume of the plasma by transferring thermal energy to a medium external (e.g., external heat sink) to the plasma cell 102. In one embodiment, the temperature control element may include, but is not limited to, a cooling element for cooling plasma cell 102, the plasma 104, the gas, the transmission element 108 (or bulb), the one or more flanges 122,124, the top flow control element 106, the bottom flow control element 107, the one or more convection enhancement elements 115 and/or the plasma plume.

In one embodiment, the plasma cell 102 may include a heat exchanger 126 suitable for transferring heat to/from a portion of the plasma cell 102 from/to an external medium. For example, as shown in FIG. 1C, a heat exchanger 126 may be positioned within the plasma cell 102 and proximate to the top flow control element 106. In this regard, the heat exchanger 126 may readily transfer heat from the top flow control element 106 (and the gas and/or plume controlled by the top flow control element 106) to an external medium. By way of another example, although not shown, a heat exchanger 126 may be positioned within the plasma cell 102 and proximate to the bottom flow control element 107. In this regard, a heat exchanger 126 may readily transfer heat to/from the bottom flow control element 106 from/to an external medium.

In another embodiment, the plasma cell 102 may include one or more cooling feedthroughs 128, 130 (e.g., water cooling or heat pipes). In one embodiment, the one or more cooling feedthroughs 128, 130 may transfer heat from the top flow control element 106 and/or the one or more bottom flow control element 107 to an external medium. In another embodiment, the one or more cooling feedthroughs 128, 130 (e.g., water cooling lines or heat pipes) may be place in thermal communication with a heat exchanger 126. For example, the heat exchanger 126 may be placed in thermal communication with the top flow control element 106 or the bottom flow control element 107. In turn, the one or more cooling feedthroughs 128, 130 may transfer heat from the heat exchanger 126 to an external medium, thereby providing an active cooling pathway to the top flow control element 106 and/or the bottom flow control element 107. It is noted herein that, in the case of the top flow control element 106, the thermal control elements (e.g., heat exchanger 126 and cooling feedthroughs 128) may facilitate the cold gas return via the gas return channel 110. In this regard, the heat exchanger 126 and the cooling feedthroughs 128 may serve to cool the gas/plume as it exits the internal channel 109*a* of the top flow control element 106. Upon cooling, the gas is returned to the region below the plasma 104 via the one or more gas return loops 110 and fed back into the plasma generation region 111 via the bottom flow control element 107. It is further recognized herein that through the adjust of the amount of cooling (or heating) performed by the thermal control elements and/or the thermal pumping performed by the one or more convection enhancement elements 115 the plasma cell 102 (or a user of a plasma cell via a user interface) may actively control the gas flow rates in various parts of the plasma cell 102.

The utilization of heat transfer elements is generally described in U.S. patent application Ser. No. 13/647,680, filed on Oct. 9, 2012, which is incorporated by reference above in the entirety. The utilization of heat transfer elements is also generally described in U.S. patent application Ser. No. 12/787,827, filed on May 26, 2010, which is incorporated by reference above in the entirety. The utilization of heat transfer elements is also generally described in U.S. patent application Ser. No. 14/224,945, filed on Mar. 25, 2014, which is incorporated by reference above in the entirety.

FIG. 1D illustrates a simplified schematic view of a top flow control element 106 arranged to at least partially shield a component 131 from radiation emitted by the plasma 104 (or the illumination source), in accordance with an embodiment of the present invention. For example, the top flow control element 106 may be positioned so as to absorb or reflect at least a portion of radiation emitted by the plasma 104, thereby shielding component 131 from radiation-induced degradation. It is noted herein that component 131 may include any component of plasma cell 102 subject to radiation degradation. For example, the component may include, but is not limited to, a seal used to form a vacuum between a transmission element 108 and a flange 122. While FIG. 1D has focused on the top flow control element 106, it is recognized herein that bottom flow control element 107 may also be arranged to at least partially shield a component from radiation emitted by the plasma 104 (or the illumination source 101).

FIG. 1E illustrates a simplified schematic view of a top flow control element 106 including an internal channel 109*a* wall coated with a reflective material 133, in accordance with an embodiment of the present invention. For example, the internal channel 109*a* of top flow control element 106 may be coated with a material 133 that is reflective to a desired spectral range of the radiation (e.g., VUV, DUV, UV and/or visible) emitted by the plasma 104. For instance, the top flow control element 106 may be coated with a metallic material that is reflective to a portion of the radiation emitted by the plasma 104. In this regard, the coated internal channel 109*a* may serve as a waveguide to radiation emitted by the plasma 104, guiding the radiation to a selected target. For instance, the coating layer 133 disposed on the wall of internal channel 109*a* may serve to guide radiation to a thermal pump 135, as shown in FIG. 1E. In this regard, the guided radiation may serve to heat the thermal pump 135, as described previously herein. While the above descriptions focuses on the implementation of a reflective layer 133 in the internal channel 109*a* of the top flow control element 109*a*, it is noted herein that this is extendable to the bottom flow control element 109*b*. For example, although not shown, the internal channel 109*b* of the bottom flow control element 107 may be coated with a material that is reflective to a desired spectral range of the radiation (e.g., VUV, DUV, UV and/or visible) emitted by the plasma 104. It is recognized herein that the coating material used to coat the wall of the internal channels 109*a*, 109*b* of flow control elements 106, 107 may include any metallic or non-metallic material known in the art used for guiding VUV, DUV, UV and/or visible radiation.

FIGS. 1F and 1G depict schematic illustrations of one or more features formed on an external surface or internal surface of the top flow control element 106 or the bottom flow control element 107 configured to impart rotational or spiral motion to a flow of gas within the plasma cell 102. In one embodiment, as shown in FIG. 1F, the top flow control element 106 may include one or more features formed on an internal surface of the top flow control element 106 (or the bottom flow control element 107) suitable for imparting rotational or spiral motion to a flow of gas within the plasma cell 102. For instance, the internal wall of the internal channel 109*a* of the top flow control element 106 may include rifling features 136 configured to impart a rotational or spiral motion to the gas flowing through the internal channel 109*a*. In another embodiment, although not shown, the bottom flow control element 107 may include one or more features formed on an internal surface of the bottom flow control element 107 suitable for imparting rotational or spiral motion to a flow of gas within the plasma cell 102. For instance, the internal wall of the internal channel 109*b* of the bottom flow control element 107 may also include rifling features 136 configured to impart a rotational or spiral motion to the gas flowing through the internal channel 109*b*.

In another embodiment, as shown in FIG. 1G, the top flow control element 106 may include one or more features formed on an external surface of the top flow control element 106 (or the bottom flow control element 107) suitable for imparting rotational or spiral motion to a flow of gas within the plasma cell 102. For instance, the external wall of the top flow control element 106 may include rifling features 138 configured to impart a rotational or spiral motion to the gas flowing through the plasma cell 102. In another embodiment, although not shown, the bottom flow control element 107 may include one or more features formed on an external surface of the bottom flow control element 107 suitable for imparting rotational or spiral motion to a flow of gas within the plasma cell 102. For instance, the external wall of the bottom flow control element 107 may also include rifling features 138 configured to impart a rotational or spiral motion to the gas flowing through the plasma cell 102.

It is recognized herein that the top flow control element 106 and/or the bottom flow control element 107 may be constructed of any suitable material known in the art to establish a desired set of heat, electrical and mechanical characteristics. In one embodiment, the top flow control element 106 and/or the bottom flow control element 107 may be formed from a metal material. For example, in cases where the top flow control element 106 and/or the bottom flow control element 107 are multi-purposed to also serve as an electrode of the plasma cell 102, the top flow control element 106 and/or the bottom flow control element 107 may be constructed of an electrode-suitable material. For instance, the top flow control element 106 and/or the bottom flow control element 107 may include, but not limited to, aluminum, copper and the like. In another embodiment, the top flow control element and/or the bottom flow control element may be formed from a non-metal material. For example, the top flow control element 106 and/or the bottom flow control element 107 may be constructed of a non-metal material, in cases where the gas or gas mixture used in the plasma cell 102 is incapable with metal. For instance, the top flow control element 106 and/or the bottom flow control element 107 may include, but not limited to, a ceramic material.

Referring again to FIGS. 1B and 1C, in another embodiment, the transmission element 108 may have one or more openings (e.g., top and bottom openings). In another embodiment, one or more flanges 122, 124 are disposed at the one or more openings 122, 124 of the transmission element 108. In one embodiment, the one or more flanges 122, 124 are configured to enclose the internal volume of the transmission element 108 so as to contain a volume of gas within the body of the transmission element 108 of the plasma cell 102. In one embodiment, the one or more openings may be located at one or more end portions of the transmission element 108. For example, as shown in FIGS. 1B and 1C, a first opening may be located at a first end portion (e.g., top portion) of the transmission element 108, while a second opening may be located at a second end portion (e.g., bottom portion), opposite of the first end portion, of the transmission element 108. In another embodiment, the one or more flanges 122, 124 are arranged to terminate the transmission element 108 at the one or more end portions of the transmission element, as shown in FIGS. 1B and 1C. For example, a first flange 122 may be positioned to terminate the transmission element 108 at the first opening, while the second flange 124 may be positioned to terminate the transmission element 108 at the second opening. In another embodiment, the first opening and the second opening are in fluidic communication with one another such that the internal volume of the transmission element 108 is continuous from the first opening to the second opening. In another embodiment, although not shown, the plasma cell 102 includes one or more seals. In one embodiment, the seals are configured to provide a seal between the body of the transmission element 108 and the one or more flanges 122, 124. The seals of the plasma cell 102 may include any seals known in the art. For example, the seals may include, but are not limited to, a brazing, an elastic seal, an O-ring, a C-ring, a metal seal and the like. In one embodiment, the seals may include one or more soft metal alloys, such as an indium-based alloy. In another embodiment, the seals may include an indium-coated C-ring. The generation of plasma in a flanged plasma cell is also described in U.S. patent application Ser. No. 14/231,196, filed on Mar. 31, 2014, which is incorporated by reference herein in the entirety.

It is noted herein that while the present disclosure generally focuses on a plasma cell 102 including a transmission element 108, as shown in FIGS. 1A-1C and 1E), this is not limiting and should be interpreted as illustrative. It is further recognized herein that the plasma cell 102 may include a number of gas-containing structures suitable for initiating and/or maintaining a plasma 104. For example, the plasma cell 102 may include, but is not limited to, a plasma bulb (not shown) suitable for initiating and/or maintaining a plasma 104. It is further noted herein that the various components and structures described herein with respect to the flow control elements 106, 107 and related internal structures of plasma cell 102 may be extended to embodiments implementing a plasma bulb. The implementation of a plasma bulb is generally described in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are each incorporated previously herein by reference in the entirety.

In one embodiment, the plasma cell 102 may contain any selected gas (e.g., argon, xenon, mercury or the like) known in the art suitable for generating a plasma upon absorption of suitable illumination. In one embodiment, focusing illumination 103 from the illumination source 101 into the volume of gas causes energy to be absorbed through one or more selected absorption lines of the gas or plasma within the transmission element 108, thereby "pumping" the gas species in order to generate or sustain a plasma. In another embodiment, although not shown, the plasma cell 102 may include a set of electrodes for initiating the plasma 104 within the internal volume 103 of the transmission element 108, whereby the illumination source 103 from the illumination source 101 maintains the plasma 104 after ignition by the electrodes. In another embodiment, as previously noted, top flow control element 106 and/or the bottom flow control element 107 may be configured to serve as an electrode of the plasma cell 102 for initiating the plasma 104 within the internal volume of the transmission element 108, whereby the illumination 103 from the illumination source 101 maintains the plasma 104 after ignition by the electrodes.

It is contemplated herein that the system 100 may be utilized to initiate and/or sustain a plasma 104 in a variety of gas environments. In one embodiment, the gas used to initiate and/or maintain plasma 104 may include an inert gas (e.g., noble gas or non-noble gas) or a non-inert gas (e.g., mercury). In another embodiment, the gas used to initiate and/or maintain a plasma 104 may include a mixture of gases (e.g., mixture of inert gases, mixture of inert gas with non-inert gas or a mixture of non-inert gases). For example, it is anticipated herein that the volume of gas used to generate a plasma 104 may include argon. For instance, the gas may include a substantially pure argon gas held at pressure in excess of 5 atm (e.g., 20-50 atm). In another instance, the gas may include a substantially pure krypton gas held at pressure in excess of 5 atm (e.g., 20-50 atm). In another instance, the gas 103 may include a mixture of argon gas with an additional gas.

It is further noted that the present invention may be extended to a number of gases. For example, gases suitable for implementation in the present invention may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, the present invention should be interpreted to extend to any light pumped plasma generating system and should further be interpreted to extend to any type of gas suitable for sustaining a plasma within a plasma cell.

The transmission element 108 (or bulb) of system 100 may be formed from any material known in the art that is at least partially transparent to radiation generated by plasma 104. In one embodiment, the transmission element 108 of system 100 may be formed from any material known in the art that is at least partially transparent to VUV radiation generated by plasma 104. In another embodiment, the transmission element 108 of system 100 may be formed from any material known in the art that is at least partially transparent to DUV radiation generated by plasma 104. In another embodiment, the transmission element 108 of system 100 may be formed from any material known in the art that is at least partially transparent to UV light generated by plasma 104. In another embodiment, the transmission element 108 of system 100 may be formed from any material known in the art at least partially transparent to visible light generated by plasma 104.

In another embodiment, the transmission element 108 (or bulb) may be formed from any material known in the art transparent to radiation 103 (e.g., IR radiation) from the illumination source 101. In another embodiment, the transmission element 108 (or bulb) may be formed from any material known in the art transparent to both radiation from the illumination source 101 (e.g., IR source) and radiation (e.g., VUV radiation, DUV radiation, UV radiation and/or visible radiation) emitted by the plasma 104 contained within the volume of the transmission element 108. In some embodiments, the transmission element 108 (or bulb) may be formed from a low-OH content fused silica glass material. In other embodiments, the transmission element 108 (or bulb) may be formed from high-OH content fused silica glass material. For example, the transmission element 108 (or bulb) may include, but is not limited to, SUPRASIL 1, SUPRASIL 2, SUPRASIL 300, SUPRASIL 310, HERALUX PLUS, HERALUX-VUV, and the like. In other embodiments, the transmission element 108 (or bulb) may include, but is not limited to, calcium fluoride ($CaF_2$), magnesium fluoride ($MgF_2$), crystalline quartz and sapphire. It is noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the glass bulb of the present invention are discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety.

The transmission element 108 (or bulb) may take on any shape known in the art. In one embodiment, the transmission element 108 may have a cylindrical shape, as shown in FIGS. 1B and 1C. In another embodiment, although not shown, the transmission element 108 may have a spherical or ellipsoidal shape. In another embodiment, although not shown, the transmission element 108 may have a composite shape. For example, the shape of the transmission element 108 may consist of a combination of two or more shapes. For instance, the shape of the transmission element 108 may consist of a spherical or ellipsoidal center portion, arranged to contain the plasma 104, and one or more cylindrical portions extending above and/or below the spherical or ellipsoidal center portion, whereby the one or more cylindrical portions are coupled to the one or more flanges 122,124. In the case where the transmission element 108 is cylindrically shaped, as shown in FIG. 1B, the one or more openings of the transmission element 108 may be located at the end portions of the cylindrically shaped transmission element 108. In this regard, the transmission element 108 takes the form of a hollow cylinder, whereby a channel extends from the first opening (top opening) to the second opening (bottom opening). In another embodiment, the first flange 122 and the second flange 124 together with the wall(s) of the transmission element 108 serve to contain the volume of gas within the channel of the transmission element 108. It is recognized herein that this arrangement may be extended to a variety of transmission element 108 shapes, as described previously herein.

In settings where a plasma bulb is implemented within the plasma cell 102, the plasma bulb may also take on any shape known in the art. In one embodiment, the plasma bulb may have a cylindrical shape. In another embodiment, the plasma bulb may have a spherical or ellipsoidal shape. In another embodiment, the plasma bulb may have a composite shape. For example, the shape of the plasma bulb may consist of a combination of two or more shapes. For instance, the shape of the plasma bulb may consist of a spherical or ellipsoidal center portion, arranged to contain the plasma 104, and one or more cylindrical portions extending above and/or below the spherical or ellipsoidal center portion.

In another embodiment, the system 100 includes a collector/reflector element 105 configured to focus illumination emanating from the illumination source 101 into the volume of gas contained within the transmission element 108 (or bulb) of the plasma cell 102. The collector element 105 may take on any physical configuration known in the art suitable for focusing illumination emanating from the illumination source 101 into the volume of gas contained within the plasma cell 102. In one embodiment, as shown in FIG. 1A, the collector element 105 may include a concave region with a reflective internal surface suitable for receiving illumination 103 from the illumination source 101 and focusing the illumination 103 into the volume of gas contained within the plasma cell 102. For example, the collector element 105 may include an ellipsoid-shaped collector element 105 having a reflective internal surface, as shown in FIG. 1A.

In another embodiment, the collector element 105 is arranged to collect broadband illumination 142 (e.g., VUV radiation, DUV radiation, UV radiation and/or visible radiation) emitted by plasma 104 and direct the broadband illumination to one or more additional optical elements (e.g., filter 150, homogenizer 152 and the like). For example, the collector element 105 may collect at least one of VUV broadband radiation, DUV radiation, UV radiation or visible radiation emitted by plasma 104 and direct the broadband illumination 142 to one or more downstream optical elements. In this regard, the plasma cell 102 may deliver VUV radiation, UV radiation and/or visible radiation to downstream optical elements of any optical characterization system known in the art, such as, but not limited to, an inspection tool or a metrology tool. It is noted herein the plasma cell 102 of system 100 may emit useful radiation in a variety of spectral ranges including, but not limited to, DUV radiation, VUV radiation, UV radiation, and visible radiation.

In one embodiment, system 100 may include various additional optical elements. In one embodiment, the set of additional optics may include collection optics configured to collect broadband light emanating from the plasma 104. For instance, the system 100 may include a cold mirror 148 arranged to direct illumination from the collector element 105 to downstream optics, such as, but not limited to, a homogenizer 152.

In another embodiment, the set of optics may include one or more lenses (e.g., lens 144) placed along either the illumination pathway or the collection pathway of system 100. The one or more lenses may be utilized to focus illumination from the illumination source 101 into the volume of gas within the plasma cell 102. Alternatively, the one or more additional lenses may be utilized to focus broadband light emanating from the plasma 104 onto a selected target (not shown).

In another embodiment, the set of optics may include a turning mirror 146. In one embodiment, the turning mirror 146 may be arranged to receive illumination 103 from the illumination source 101 and direct the illumination to the volume of gas contained within the plasma cell 102 via collection element 105. In another embodiment, the collection element 105 is arranged to receive illumination from mirror 146 and focus the illumination to the focal point of the collection element 105 (e.g., ellipsoid-shaped collection element), where the transmission element 108 (or bulb) of the plasma cell 102 is located.

In another embodiment, the set of optics may include one or more filters 150 placed along either the illumination pathway or the collection pathway in order to filter illumination prior to light entering the plasma cell 102 or to filter illumination following emission of the light from the plasma 104. It is noted herein that the set of optics of system 100 as described above and illustrated in FIG. 1A are provided merely for illustration and should not be interpreted as limiting. It is anticipated that a number of equivalent or additional optical configurations may be utilized within the scope of the present invention.

In another embodiment, the illumination source 101 of system 100 may include one or more lasers. In a general sense, the illumination source 101 may include any laser system known in the art. For instance, the illumination source 101 may include any laser system known in the art capable of emitting radiation in the infrared, visible or ultraviolet portions of the electromagnetic spectrum. In one embodiment, the illumination source 101 may include a laser system configured to emit continuous wave (CW) laser radiation. For example, the illumination source 101 may include one or more CW infrared laser sources. For example, in settings where the gas within the plasma cell 102 is or includes argon, the illumination source 101 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting and any laser known in the art may be implemented in the context of the present invention.

In another embodiment, the illumination source 101 may include one or more diode lasers. For example, the illumination source 101 may include one or more diode lasers emitting radiation at a wavelength corresponding with any one or more absorption lines of the species of the gas contained within the plasma cell 102. In a general sense, a diode laser of the illumination source 101 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the plasma cell 102 of system 100.

In another embodiment, the illumination source 101 may include an ion laser. For example, the illumination source 101 may include any noble gas ion laser known in the art. For instance, in the case of an argon-based plasma, the illumination source 101 used to pump argon ions may include an Ar+ laser.

In another embodiment, the illumination source 101 may include one or more frequency converted laser systems. For example, the illumination source 101 may include a Nd:YAG or Nd:YLF laser having a power level exceeding 100 watts. In another embodiment, the illumination source 101 may include a broadband laser. In another embodiment, the illumination source may include a laser system configured to emit modulated laser radiation or pulsed laser radiation.

In another embodiment, the illumination source 101 may include one or more lasers configured to provide laser light at substantially a constant power to the plasma 104. In another embodiment, the illumination source 101 may include one or more modulated lasers configured to provide modulated laser light to the plasma 104. In another embodiment, the illumination source 101 may include one or more pulsed lasers configured to provide pulsed laser light to the plasma.

In another embodiment, the illumination source 101 may include one or more non-laser sources. In a general sense, the illumination source 101 may include any non-laser light source known in the art. For instance, the illumination source 101 may include any non-laser system known in the art capable of emitting radiation discretely or continuously in the infrared, visible or ultraviolet portions of the electromagnetic spectrum.

In another embodiment, the illumination source 101 may include two or more light sources. In one embodiment, the illumination source 101 may include or more lasers. For example, the illumination source 101 (or illumination sources) may include multiple diode lasers. By way of another example, the illumination source 101 may include multiple CW lasers. In a further embodiment, each of the two or more lasers may emit laser radiation tuned to a different absorption line of the gas or plasma within the plasma cell 102 of system 100.

FIG. 1H illustrates a cross-sectional schematic view of the plasma cell 102, in accordance with one embodiment of the present invention. As shown in FIG. 1H, as noted previously herein and in addition to the various elements and features described previously herein, in one embodiment, the plasma cell 102 includes a top flow control element 106 equipped with an internal channel 109*a*. In another embodiment, the plasma cell 102 includes a bottom flow control element 107 equipped with an internal channel 109*b*. In another embodiment, the plasma cell 102 includes a transmission element 108 suited for transmitting light from the light source 101 (not shown in FIG. 1H) and further suited for transmitting broadband radiation from the plasma 104 to downstream optical elements. In another embodiment, the plasma cell 102 includes a top flange 122 and bottom flange 124. In another embodiment, the top flange 122 and bottom flange 124 may be mechanically coupled via one or more connecting rods 140, thereby sealing the plasma cell 102. The use of a flanged plasma cell is described in U.S. patent application Ser. No. 14/231,196, filed on Mar. 31, 2014, which is incorporated previously herein by reference in the entirety.

While the present disclosure has focused on the system 100 and plasma cell in the context of both top and bottom flow control elements 106,107, it is noted herein that this is not a limitation on the present invention. Rather, the description provided previously herein should be interpreted as illustrative only. In one embodiment, the plasma cell 102 of system 100 may include a single flow one or more flow control elements (e.g., single flow control element) disposed within the transmission element 108. In another embodiment, the one or more flow control elements (e.g., single flow control element) may include one or more internal channels (e.g., similar to internal channels 109*a*,109*b* previously described herein) configured to direct gas in a selected direction (e.g., upward, downward and the like). In another embodiment, the one or more flow control elements (e.g., single flow control element) may be arranged within the transmission element 108 to form one or more gas return channels (e.g., similar to gas return channel 110 previously described herein) transferring gas from a region above the plasma generation region 111 to a region below the plasma generation region. It is further noted that the various components and embodiments described throughout the present disclosure with respect to system 100 and method 200 should be interpreted to extend to this embodiment.

FIG. 2 is a flow diagram illustrating steps performed in a method 200 for controlling convection in a plasma cell. Applicant notes that the embodiments and enabling technologies described previously herein in the context of system 100 should be interpreted to extend to method 200. It is further noted, however, that the method 200 is not limited to the architecture of system 100. For example, it is recognized that at least a portion of the steps of method 200 may be carried out utilizing a plasma cell equipped with a plasma bulb.

In a first step 202, illumination is generated. For example, as shown in FIG. 1A, an illumination source 101 may generate illumination 103 suitable for pumping a selected gas (e.g., argon, xenon, mercury and the like) to form a plasma 104. For instance, the illumination source may include, but is not limited to, an infrared radiation source, a visible radiation source or an ultraviolet radiation source.

In a second step 204, a volume of gas is contained. For example, as shown in FIGS. 1A through 1H, a volume of gas 103 (e.g., argon, xenon, mercury and the like) is contained within the internal volume of the transmission element 108 by terminating the end(s) of the transmission element 108 with one or more flanges 122, 124. By way of another example, the volume of gas may be contained with a plasma bulb (not shown).

In a third step 206, at least a portion of the generated illumination is focused through a transmission element 108 of the plasma cell 102 into the volume of gas contained within the transmission element 108 of the plasma cell 102. For example, as shown in FIG. 1A, a collector element 105 having a generally ellipsoidal shape and an internal reflective surface may be arranged such that it directs illumination 103 from the illumination source 101 to a volume of gas contained with the internal volume of the transmission element 108. In this regard, the transmission element 108 is at least partially transparent to a portion of the illumination 103 from the illumination source 101.

In a fourth step 208, broadband radiation is generated. For example, broadband radiation is generated by forming a plasma via absorption of the focused generated illumination by the volume of gas contained within the internal volume of the transmission element 108 of plasma cell 102. In a fifth step 210, at least a portion of a plume (or gas) of the plasma 104 is directed upward with one or more internal channels 109*a* of a top flow control element 106.

In a sixth step 212, gas is directed upward toward the plasma generation region 104 with one or more internal channels 109*b* of a bottom flow control element 107. In a seventh step 214, gas is transferred from a region above the plasma generation region (e.g., top circulation loop) to a region below the plasma generation region (e.g., bottom circulation loop) with one or more gas return channels 110.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A plasma cell for controlling convection comprising:

a transmission element having one or more openings, the transmission element configured to receive illumination from an illumination source in order to generate a plasma within a plasma generation region of a volume of gas, wherein the plasma emits broadband radiation, wherein the transmission element of the plasma cell is at least partially transparent to at least a portion of the illumination generated by the illumination source and at least a portion of the broadband radiation emitted by the plasma; and one or more gas return channels formed within the transmission element for transferring gas from a region above the plasma generation region to a region below the plasma generation region.

2. The plasma cell of claim 1, wherein the one or more gas return channels are configured to balance a flow of gas from the plume of the plasma with a flow of gas delivered to the plasma.

3. The plasma cell of claim 2, wherein the one or more gas return channels are configured to balance a flow of gas from the plume of the plasma with a flow of gas delivered to the plasma in order to maintain a gas flow rate of a center circulation loop within the transparent element at or below a selected level.

4. The plasma cell of claim 1, wherein the one or more gas return channels are configured to transfer gas from a top circulation loop to a bottom circulation loop.

5. The plasma cell of claim 1, further comprising:

a top flow control element disposed above the plasma generation region and within the transmission element, the top flow control element including one or more internal channels configured to direct at least a portion of a plume of the plasma upward; and a bottom flow control element disposed below the plasma generation region and within the transmission element, the bottom flow control element including one or more internal channels configured to direct gas upward toward the plasma generation region.

6. The plasma cell of claim 5, wherein at least one of the top flow control or the bottom flow control element comprises at least one of a top deflector or a bottom deflector.

7. The plasma cell of claim 5, wherein the top flow control element and the transmission element are arranged to form one or more top circulation loops.

8. The plasma cell of claim 5, wherein the bottom flow control element and the transmission element are arranged to form one or more bottom circulation loops.

9. The plasma cell of claim 5, wherein at least one of the top flow control element or the bottom flow control element are formed from at least one of a metal material or a non-metal material.

10. The plasma cell of claim 5, wherein at least one of the top flow control element or the bottom flow control are configured to shield one or more components of the plasma cell from radiation.

11. The plasma cell of claim 5, wherein one or more internal channels of the top flow control element are coated with one or more reflective materials.

12. The plasma cell of claim 5, further comprising:

one or more features formed on at least one of the external surface or internal surface of at least one of the top flow control element or the bottom flow control element configured to impart rotational motion to a flow of gas within the transmission element.

13. The plasma cell of claim 12, wherein the one or more features comprise:

rifling features formed within at least one of the external surface or internal surface of at least one of the top flow control element or the bottom flow control element.

14. The plasma cell of claim 5, wherein the bottom flow control element is heated in order to pump gas upward toward the plasma generation region.

15. The plasma cell of claim 5, further comprising:

one or more convection enhancement elements disposed within one or more internal channels of the bottom flow control element.

16. The plasma cell of claim 15, wherein the one or more convection enhancement elements comprise:

one or more gas pumps disposed within the one or more internal channels of the bottom flow control element.

17. The plasma cell of claim 16, wherein the one or more gas pumps comprise:

one or more thermal pumps.

18. The plasma cell of claim 17, wherein the one or more thermal pumps comprise:

at least one of one or more heated rods and one or more heated pipes.

19. The plasma cell of claim 17, wherein the one or more thermal pumps are heated by absorption of plasma radiation from the plasma.

20. The plasma cell of claim 16, wherein the one or more gas pumps comprise:

one or more mechanical pumps.

21. The plasma cell of claim 5, further comprising:

one or more convention enhancement elements disposed within one or more internal channels of the top flow control element.

22. The plasma cell of claim 21, wherein the one or more convection enhancement elements comprise:

one or more gas pumps.

23. The plasma cell of claim 22, wherein the one or more gas pumps comprise:

one or more thermal pumps.

24. The plasma cell of claim 23, wherein the one or more thermal pumps comprise:

at least one of one or more heated rods and one or more heated pipes.

25. The plasma cell of claim 23, wherein the one or more thermal pumps are heated by absorption of radiation from the plasma.

26. The plasma cell of claim 5, further comprising:

one or more thermal control elements disposed within the transmission element and positioned proximate to at least one of the top flow control element or the bottom flow control element.

27. The plasma cell of claim 26, wherein the one or more thermal control elements comprise:

one or more heat exchangers elements disposed within the transmission element and positioned proximate to at least one of the top flow control element or the bottom flow control element.

28. The plasma cell of claim 26, wherein the one or more thermal control elements comprise:

one or more cooling feedthroughs configured to transfer heat from at least one of the top flow control element or the bottom flow control element.

29. The plasma cell of claim 1, further comprising:

one or more external control elements.

30. The plasma cell of claim 1, wherein the one or more openings of the transmission element comprise:

a first opening at a first end of the transmission element; and a second opening at a second end of the transmission element opposite the first end.

31. The plasma cell of claim 1, wherein the transmission element includes at least a portion having at least one of a substantially cylindrical shape, a substantially spherical shape or a substantially ellipsoidal shape.

32. The plasma cell of claim 1, wherein the transmission element has a composite geometrical shape.

33. The plasma cell of claim 1, further comprising:

a first flange disposed at a first opening; and a second flange disposed at a second opening, wherein the first flange and second flange are configured to contain the volume of gas within the transmission element.

34. The plasma cell of claim 1, wherein the transmission element is formed from at least one of calcium fluoride, magnesium fluoride, crystalline quartz, sapphire and fused silica.

35. The plasma cell of claim 1, wherein the illumination source comprises:

one or more lasers.

36. The plasma cell of claim 35, wherein the one or more lasers comprise:

one or more infrared lasers.

37. The plasma cell of claim 35, wherein the one or more lasers comprise:

at least one of a diode laser, a continuous wave laser, or a broadband laser.

38. The plasma cell of claim 35, wherein the one or more lasers comprise:

one or more lasers configured to provide laser light at substantially a constant power to the plasma.

39. The plasma cell of claim 35, wherein the one or more lasers comprise:

one or more modulated lasers configured to provide modulated laser light to the plasma.

40. The plasma cell of claim 39, wherein the one or more modulated lasers comprise:

one or more pulsed lasers configured to provide pulsed laser light to the plasma.

41. The plasma cell of claim 1, wherein the gas comprises:

at least one of an inert gas, a non-inert gas or a mixture of two or more gases.

42. A plasma cell for controlling convection comprising:

a plasma bulb configured to receive illumination from an illumination source in order to generate a plasma within a plasma generation region of a volume of gas within the plasma bulb, wherein the plasma emits broadband radiation, wherein the plasma bulb is at least partially transparent to at least a portion of the illumination generated by the illumination source and at least a portion of the broadband radiation emitted by the plasma; and one or more gas return channels formed within the plasma bulb for transferring gas from a region above the plasma generation region to a region below the plasma generation region.

43. A system for controlling convention in a plasma cell comprising:

an illumination source configured to generate illumination;

a plasma cell including a transmission element having one or more openings, the transmission element configured to receive illumination from the illumination source in order to generate a plasma within a plasma generation region of a volume of gas, wherein the plasma emits broadband radiation, wherein the transmission element of the plasma cell is at least partially transparent to at least a portion of the illumination generated by the illumination source and at least a portion of the broadband radiation emitted by the plasma;

one or more gas return channels formed within the transmission element for transferring gas from a region above the plasma generation region to a region below the plasma generation region; and a collector element arranged to focus the illumination from the illumination source into the volume of gas in order to generate a plasma within the volume of gas contained within the plasma cell.

* * * * *